US005167054A

United States Patent [19]

Eschenbach

[11] Patent Number: 5,167,054

[45] Date of Patent: Dec. 1, 1992

[54] FABRIC SOFTENING APPARATUS AND METHOD

[75] Inventor: Paul W. Eschenbach, Moore, S.C.

[73] Assignee: Milliken Research Corporation, Spartanburg, S.C.

[21] Appl. No.: 747,521

[22] Filed: Aug. 20, 1991

[51] Int. Cl.[5] ..... D06C 11/00

[52] U.S. Cl. ..... 26/27

[58] Field of Search ..... 26/27, 25, 33, 36, 99; 29/110, 116.1, 121.1, 121.2, 121.5

[56] References Cited

U.S. PATENT DOCUMENTS 1,730,520 10/1929 McMurray ..... 26/27
3,406,033 10/1968 Reitz ..... 26/1
3,408,709 11/1968 Reitz ..... 26/1
4,087,226 5/1978 Mercer ..... 26/99

FOREIGN PATENT DOCUMENTS 155465 of 0000 Fed. Rep. of Germany ..... 26/27

*Primary Examiner*—Werner H. Schroeder
*Assistant Examiner*—Amy Brooke Vanatta
*Attorney, Agent, or Firm*—Earle R. Marden; H. William Petry

[57] ABSTRACT

Method and apparatus to soften the backing and consequently the material attached thereto of a nonwoven fabric by passing the back over and around a series of rollers arranged in a staggered diamond shape to break up the bond between individual fibers and clumps of fibers but maintain the bond at cross-over points of the fibers.

1 Claim, 5 Drawing Sheets

FABRIC SOFTENING APPARATUS AND METHOD

This invention relates generally to fabrics having a relatively stiff backing developed during the manufacturing of the fabric. This is especially true in the production of nonwoven fabrics in which low melt fusible fibers and/or fusible powders have been blended with other fibers in the fabric and the fabric has been heated and cooled to provide a cohesive structure.

In the production of nonwoven fabrics from the automotive and other industries a fabric is formed from a plurality of fibers made into a batt and needled to produce a cohesive structure. It has been found that if the batt includes a blend of high melt and low melt fibers or fusible powders that it can be treated in an oven to melt the low melt fibers and then allow the batt to be cooled to produce a strong integral fabric which can be readily handled during laminating, molding, etc. One of the disadvantages of this type of fabric is that the high melt fibers stick to one another rather than only at the cross-over points resulting in a stiff boardy fabric. This is especially true where the batt of fibers is needled to form loops on one side thereof leaving a backing, which when heated and cooled, is very stiff.

Therefore, it is an object of the invention to provide a method and apparatus to soften and/or make more flexible the backing of a stiff or boardy fabric.

Other objects and advantages of the invention will become readily apparent as the specification proceeds to describe the invention with reference to the accompanying drawings, in which.

Figure 1:
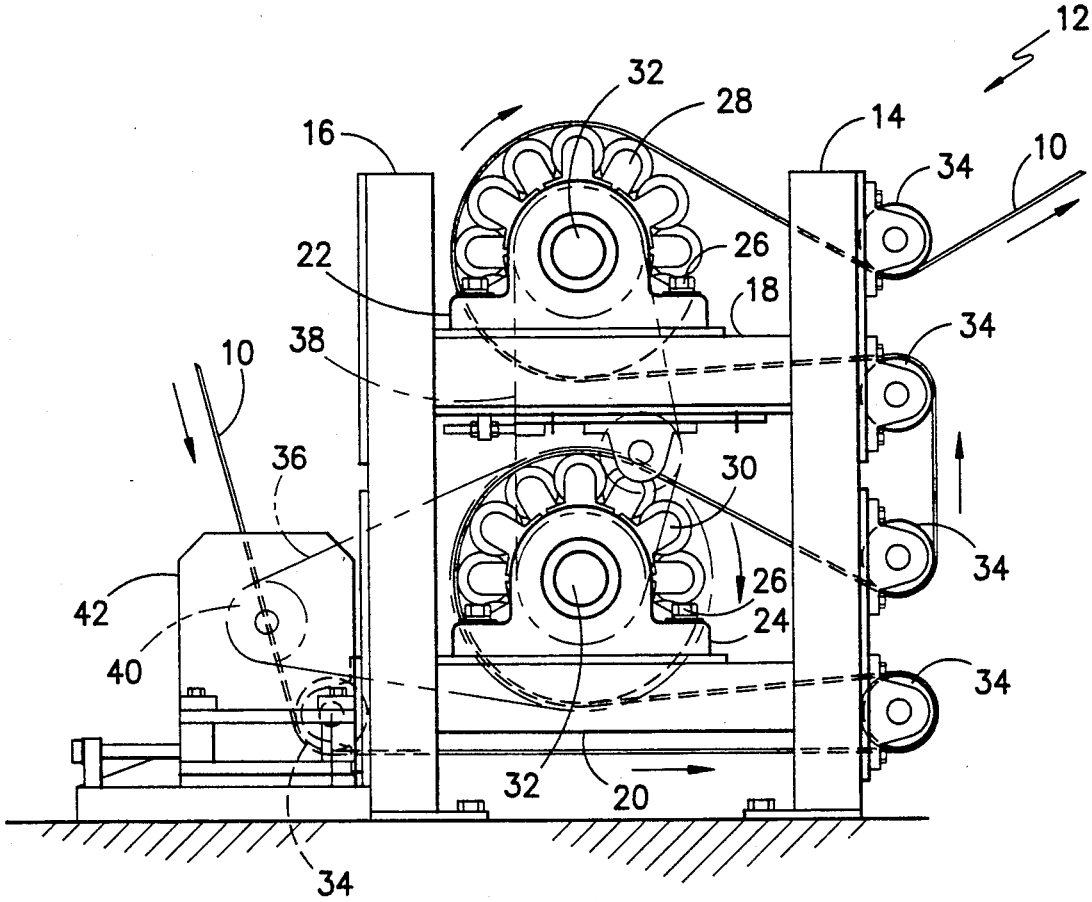
FIG. 1 is a side schematic view of the fabric softening apparatus.

Looking now to FIG. 1 the fabric 10 to be softened is shown as being delivered to the softening machine 12. In the preferred form of the invention the fabric 10 is a nonwoven fabric composed of a blend of high and low melt fibers which has been run through an oven to melt and/or soften the low melt fibers and is being delivered to the machine 12 while it is in the cooling stage before the low melt fibers have been set.

Basically the machine consists of front and back frame members 14 and 16 supporting therebetween support members 18 and 20 on which are mounted bearings 22 and 24 secured thereto by suitable means such as screws 26. Bearings 22 and 24 are mounted on both sides of the support members 18 and 20 and support softening rolls 28 and 30 therebetween by engaging shafts 32 (FIGS. 1 and 7) mounted in each end of the rolls 28 and 30. Mounted across and on the frame member 14 and 16 are idler rolls 34 to guide the fabric 10 through the machine 12. The rolls 28 and 30 are driven by timing belts 36 and 38 with timing belt 36 being driven by the pulley 40 on the motor 42 and timing belt 38 being driven off the shaft 32 of the roll 30.

Figure 2:
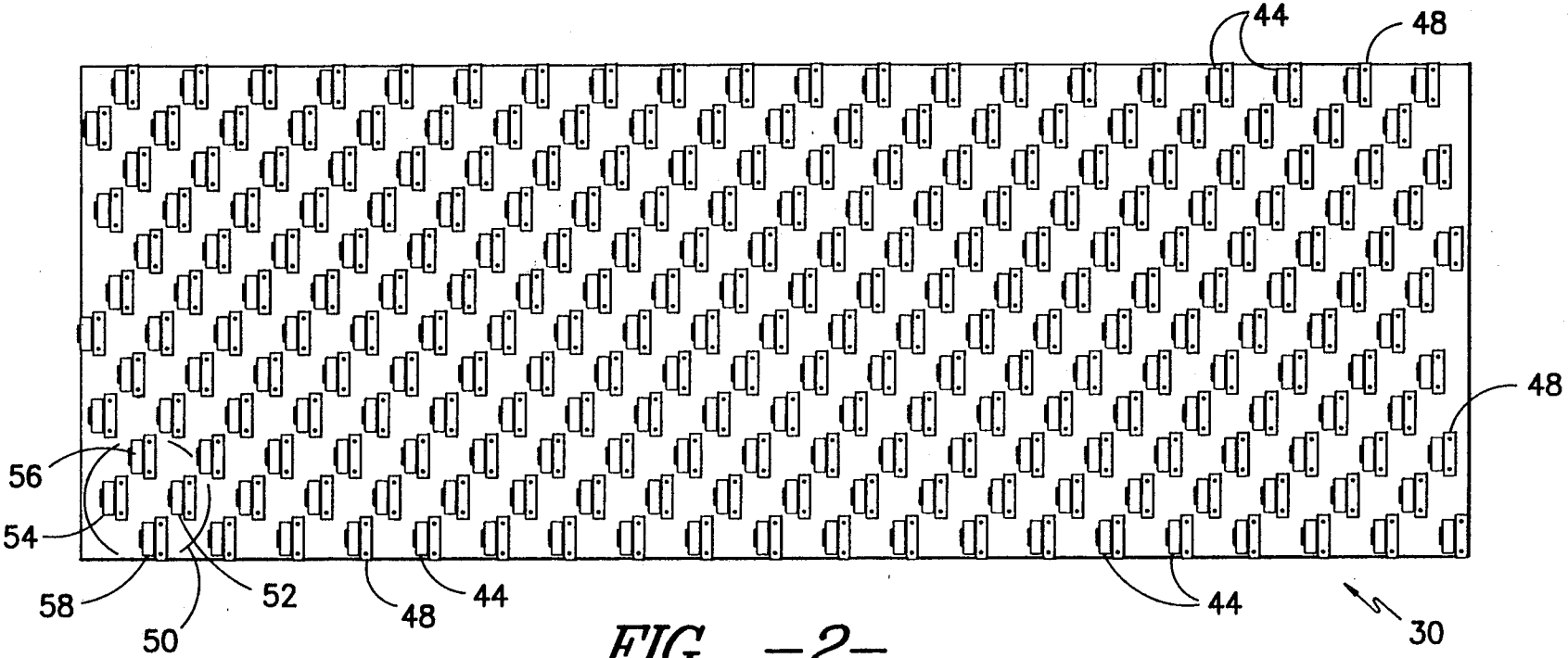
FIG. 2 is a rolled out schematic of the treatment roll shown in FIG. 3.
Figure 3:
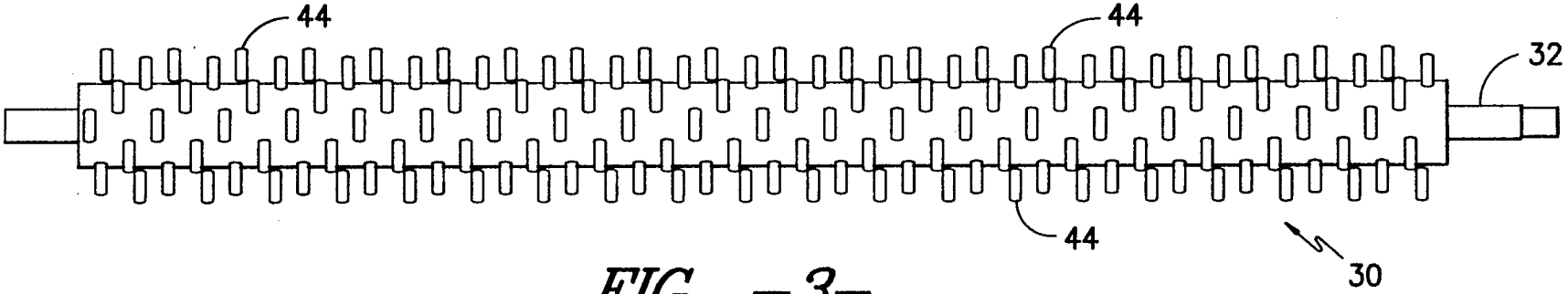
Figure 4:
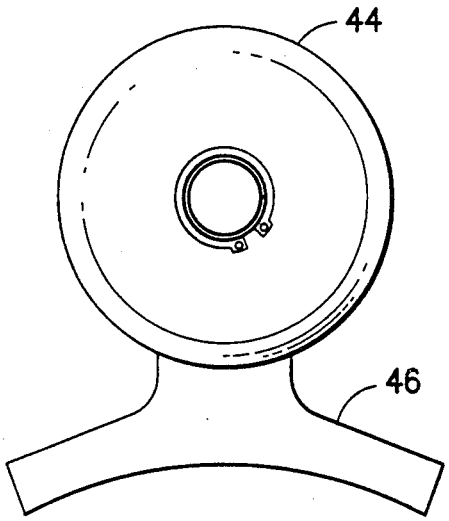
FIGS. 4 and 5 are front and side view of the roll used in the treatment roll of FIG. 3.
Figure 5:
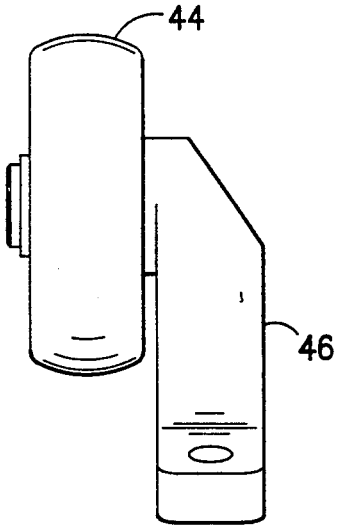

Each of the rolls 28 and 30 have a plurality of rollers 44 mounted thereon by securing the base portion 46 thereof to the roll by any suitable means such as screws 48. The rolls 28 and 30 are freely rotatable and are mounted in line in the axial direction of the rolls but adjacent rollers in each row and the next adjacent rows are located in a substantially diamond shape as shown in the portion 50 in FIG. 2. The rollers 52 and 54 are in the same row while the rollers 56 and 58 in the adjacent rows are located between the rollers 52 and 54 but spaced axially from one another approximately the width of one roller 44 to prevent the formation of lines in the fabric being treated.

Figure 6:
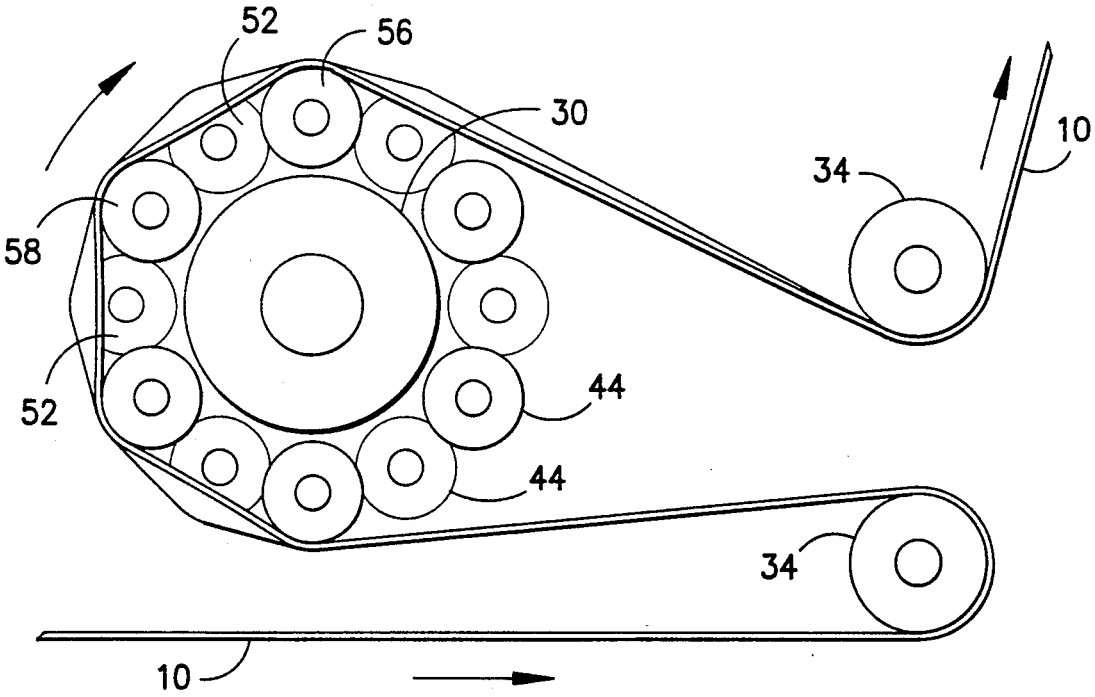
FIG. 6 is a blown-up view of the lower roll shown in FIG. 1.
Figure 7:
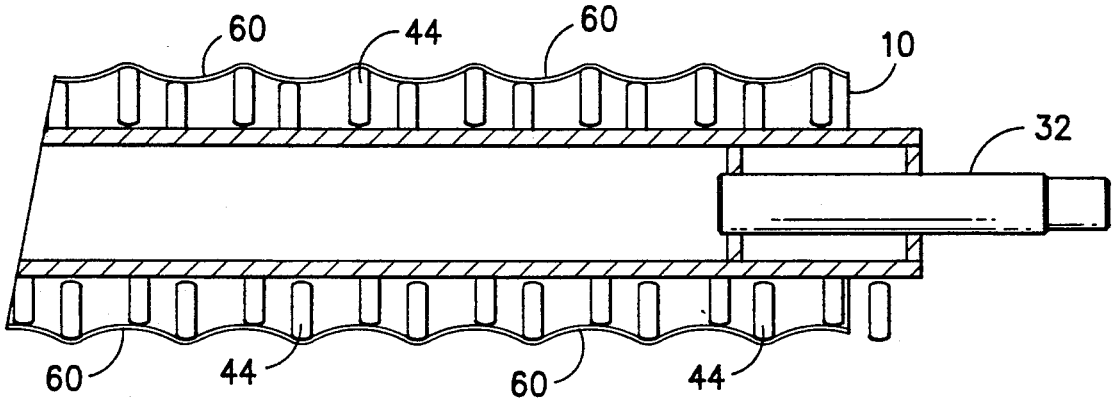
FIG. 7 is a cross-section view of one of the fabric softening rolls.

As shown in FIG. 7 the spacing of the rollers 52 and 54 allows the fabric 10 to dip or flex at 60 therebetween and the rolls 56 and 58 in the adjacent rows move the area of dip and flex. Furthermore, the displacement of the rollers 56 and 58 constantly move the areas 60 of dip and flex so that a substantially homogenous action is placed on the back of the fabric 10 to provide a thorough breaking up of the fiber-to-fiber bond of the high melt staple fibers in the fabric 10 to provide a softening effect thereto. Note FIG. 6 wherein the fabric 10 is shown contacting the rollers 56 and 58 in one position on the rolls while the next adjacent portion of the fabric 10 is contacting the rolls 52 therebetween.

Since the low melt fibers of the fabric 10 tend to migrate to one side or the other of the fabric during needling and are the fibers which are melted or softened as the fabric passes through an oven it is desired that this side of the fabric be in contact with the treatment or softening roll as indicated in FIGS. 1 and 6–9.

Figure 8:
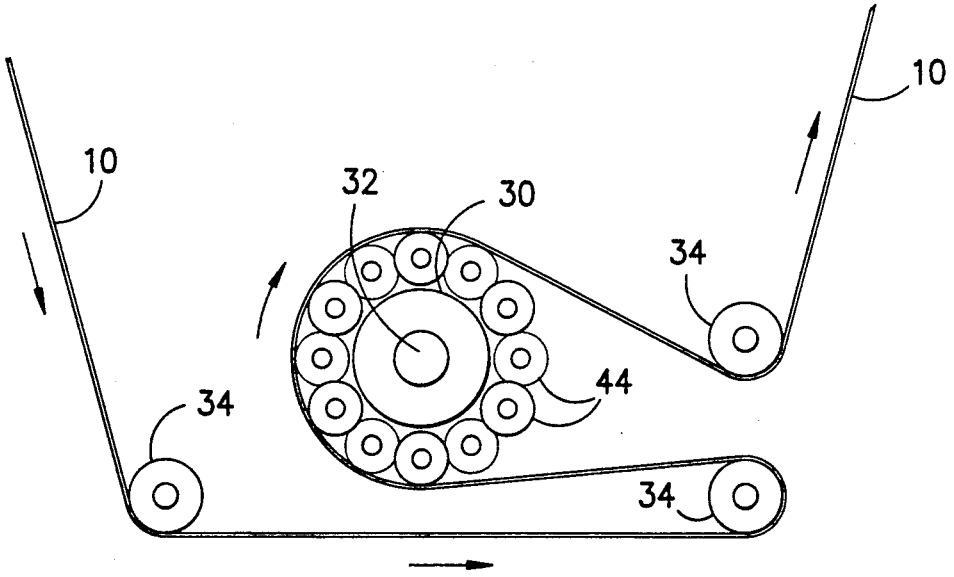
FIGS. 8–10 are schematic representations of various modifications of the invention shown in FIGS. 1–6.
Figure 9:
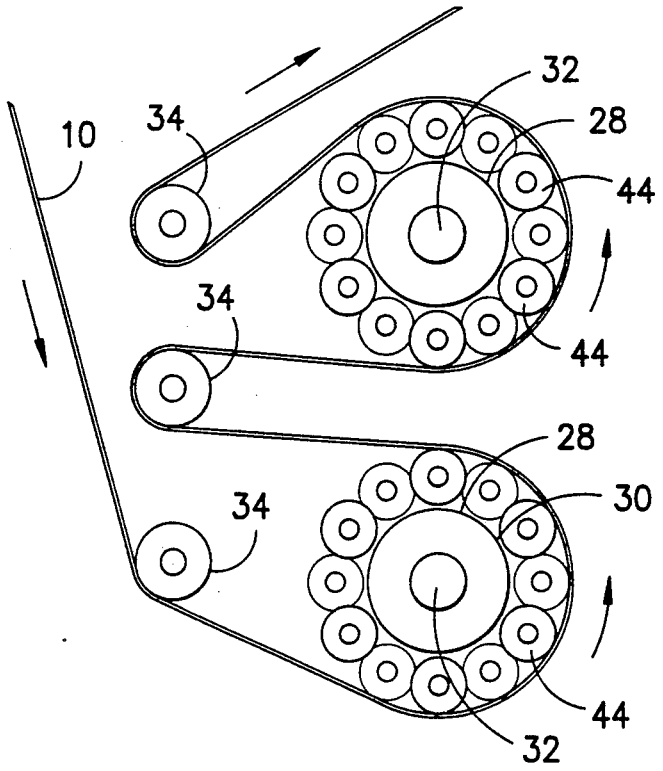
Figure 10:
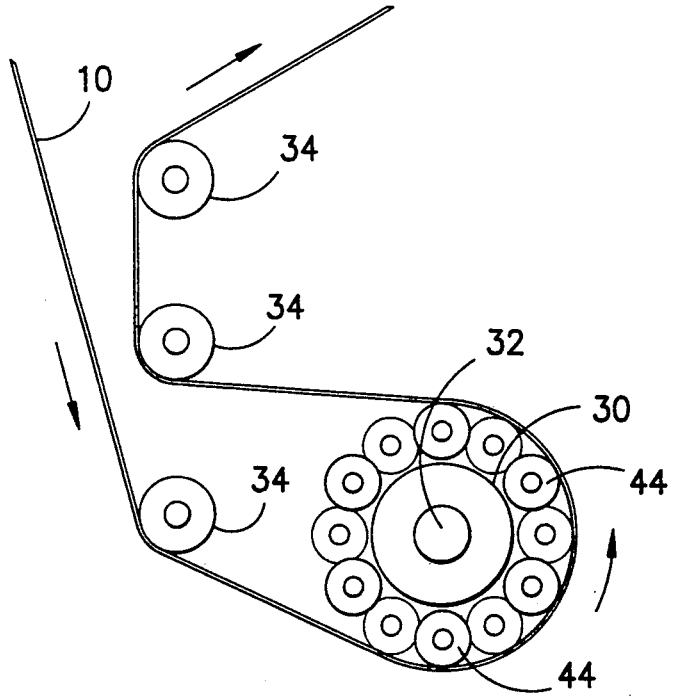

FIGS. 1 and 6 show one arrangement of softening rolls while FIGS. 7–9 show other arrangements which can be employed, if desired. In all forms of the invention, as indicated above, it is desired that the stiffened or stiffer side of the fabric 10 be in contact with the treatment roll or rolls 28 and 30. The arrangement of treatment rolls in FIGS. 1–7 and 9 illustrate a double pass arrangement while FIGS. 8 and 10 show a single pass arrangement. The difference between the arrangement of FIGS. 1–7 from that of FIG. 9 and the difference between FIG. 8 and FIG. 10 illustrates how the machine is threaded up when the fabric 10 is delivered with the stiffened side down versus when the stiffened side is up. These thread-ups of the fabric 10 is to insure maximum working of the stiff side of the fabric 10 by the rolls on the rolls 28 and 30.

It is conceivable that the rollers 44 can be fixed against rotation and will act like protuberances on the rolls 30 and 32 over which the fabric will be guided and softened. So long as proper tension is maintained and frictional heat does not build up the fabric 10 will be softened but not to the degree provided by the freely mounted rollers 44.

It is obvious that a method and apparatus have been described which operate on the back of a relatively stiff fabric to break up the fiber-to-fiber bond created during fusion of the low melt fibers in the fabric to soften the resultant fabric. Furthermore, the particular arrangement of the treating rolls is such that the fabric is continuously flexed and treated without creating a series of lines in the fabric resulting in an unattractive appearance.

The herein-described embodiments illustrate the principles of the invention and it is conceivable that other forms of the invention can be used within the scope of the invention it is therefore desired that the scope of the invention be limited only by the claims.

I claim:

1. Apparatus to soften a nonwoven fabric comprising: a roll, drive means operably associated with said roll to rotate said roll, a plurality of rows of freely rotatable rollers mounted on said roll having an axis of rotation, said axis of rotation of each roller in the same row being substantially in line with the axis of rotation of the other rollers in the same row, the rollers in each row of rollers being offset from the rollers in the next adjacent rows of rollers on said roll and means to guide fabrics into and out of contact with said rollers.

* * * * *